US006764413B2

(12) United States Patent
Ho

(10) Patent No.: US 6,764,413 B2
(45) Date of Patent: Jul. 20, 2004

(54) REPLACEABLE GOLF CLUB

(76) Inventor: Yang Ching Ho, No. 3, Lane 21, Jiahou Rd., Dajia Jen, Taichung (TW), 437

( * ) Notice: Subject to any disclaimer, the term of this patent is extended or adjusted under 35 U.S.C. 154(b) by 0 days.

(21) Appl. No.: 10/391,078

(22) Filed: Mar. 17, 2003

(65) Prior Publication Data

US 2003/0181255 A1 Sep. 25, 2003

Related U.S. Application Data

(63) Continuation-in-part of application No. 10/004,897, filed on Dec. 7, 2001, now abandoned.

(51) Int. Cl.[7] ..... A63B 53/12; A63B 53/10; A63B 53/14

(52) U.S. Cl. ..... 473/288; 473/296; 403/296

(58) Field of Search ..... 473/288, 296, 473/307, 239, 298, 299, 245, 246, 247, 248; 403/296, 305, 370

(56) References Cited

U.S. PATENT DOCUMENTS 1,714,391 A * 5/1929 McWhirter ..... 482/148
2,463,053 A * 3/1949 Pritchard ..... 473/306
4,340,227 A * 7/1982 Dopkowski ..... 473/288
4,440,391 A * 4/1984 Saenz et al. ..... 482/148
6,371,865 B1 4/2002 Magliulo
6,447,404 B1 9/2002 Wilbur

FOREIGN PATENT DOCUMENTS

AU 1569528 9/1928

* cited by examiner

*Primary Examiner*—Stephen Blau
(74) *Attorney, Agent, or Firm*—Alan D. Kamrath; Nikolai & Mersereau, P.A.

(57) ABSTRACT

A replaceable golf club includes a primary rod, a secondary rod, an upper insertion tube inserted into a distal end of the primary rod, and a lower insertion tube inserted into a distal end of the secondary rod and combined with the upper insertion tube. Thus, the user only needs to carry one primary rod and thirteen secondary rods without having to carry thirteen golf clubs, thereby facilitating the user carrying the golf club, and thereby reducing the weight of the golf club.

13 Claims, 5 Drawing Sheets

REPLACEABLE GOLF CLUB

CROSS-REFERENCES TO RELATED APPLICATIONS

The present invention is a continuation-in-part application of the U.S. Ser. No. 10/004,897, filed on Dec. 7, 2001 now abandoned.

BACKGROUND OF THE INVENTION

1. Field of the Invention

The present invention relates to a replaceable golf club, and more particularly to a replaceable golf club, wherein the user only needs to carry one primary rod and thirteen secondary rods without having to carry thirteen golf clubs, thereby facilitating the user carrying the golf club, and thereby reducing the weight of the golf club.

2. Description of the Related Art

The closest prior art reference of which the applicant is aware is disclosed in Taiwanese Patent Publication No. 371901, entitled by "Golf Club Connector", which disclosed a golf club including two stages that are connected by a shock absorbing connector. However, the user has to carry many golf clubs (the whole golf set includes thirteen golf clubs), thereby causing inconvenience to the user when carrying the many golf clubs.

Other prior art references of which the applicant is aware are disclosed in U.S. Pat. No. 4,340,227 to Dopkowski; U.S. Pat. No. 6,371,865 to Magliulo; U.S. Pat. No. 6,447,404 to Wilbur; and Australian Patent No. 15,695/28 to Donaldson.

SUMMARY OF THE INVENTION

The primary objective of the present invention is to provide a replaceable golf club, wherein the user only needs to carry one primary rod and thirteen secondary rods without having to carry thirteen golf clubs, thereby facilitating the user carrying the golf club, and thereby reducing the weight of the golf club.

In accordance with the present invention, there is provided a replaceable golf club, comprising:

a primary rod;

a secondary rod combined with the primary rod;

an upper insertion tube inserted into a distal end of the primary rod and including an upper shock absorbing portion rested on and flush with the distal end of the primary rod;

the upper insertion tube having an inner wall having a first portion formed with a screw bore and a second portion formed with a guide groove having an inner diameter greater than that of the screw bore;

the guide groove of the upper insertion tube having a tapered shape;

a lower insertion tube inserted into a distal end of the secondary rod and including a lower shock absorbing portion rested on and flush with the distal end of the secondary rod;

the lower insertion tube includes a shaft portion inserted into the guide groove of the upper insertion tube, the shaft portion having a distal end formed with a screw portion screwed into the screw bore of the upper insertion tube; and the shaft portion of the lower insertion tube having a tapered shape to mate with that of the guide groove of the upper insertion tube, so that the upper insertion tube and the lower insertion tube are co-axial.

Further benefits and advantages of the present invention will become apparent after a careful reading of the detailed description with appropriate reference to the accompanying drawings.

DETAILED DESCRIPTION OF THE INVENTION

Figure 1:
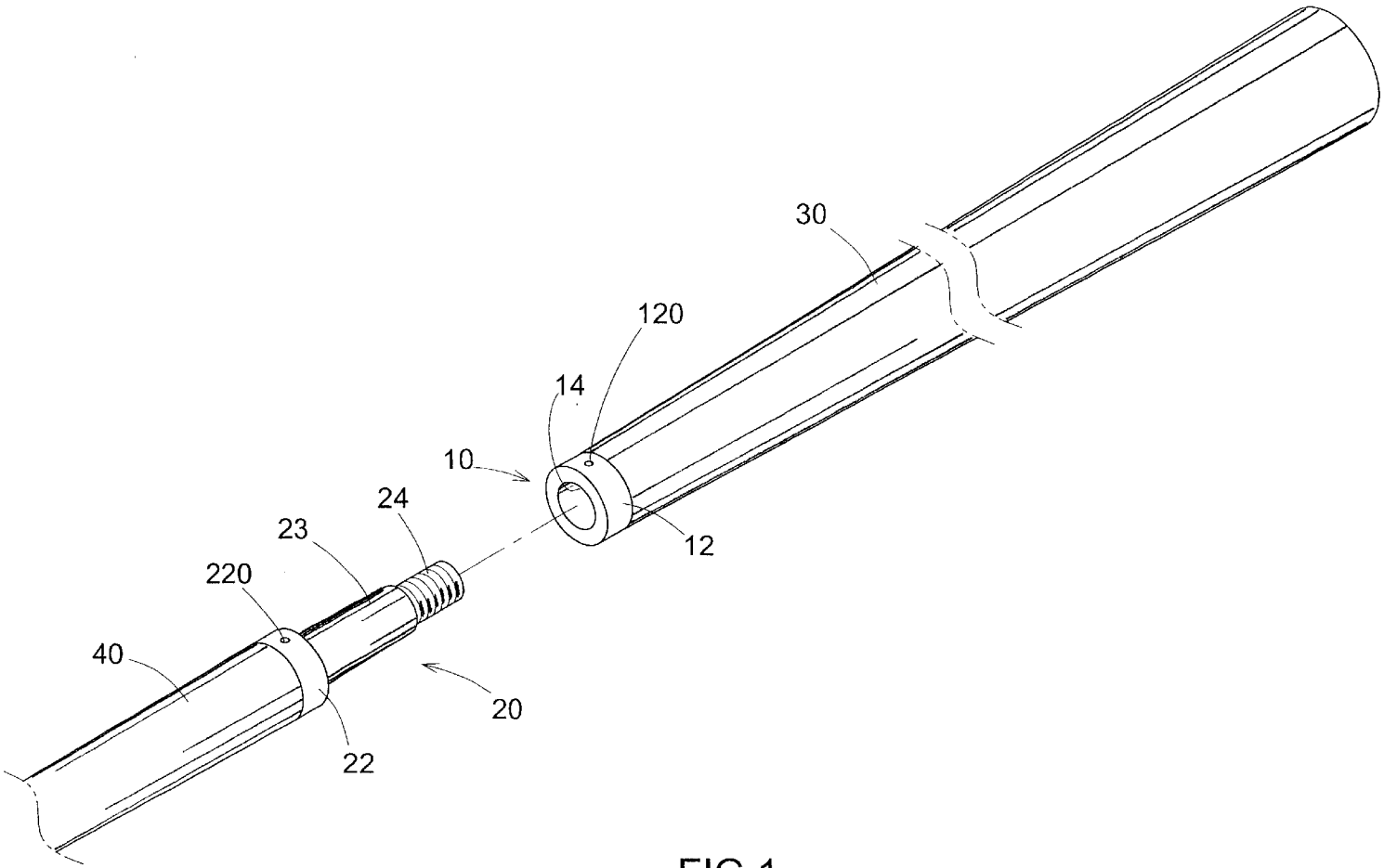
FIG. 1 is a partially exploded perspective view of a replaceable golf club in accordance with a preferred embodiment of the present invention.
Figure 2:
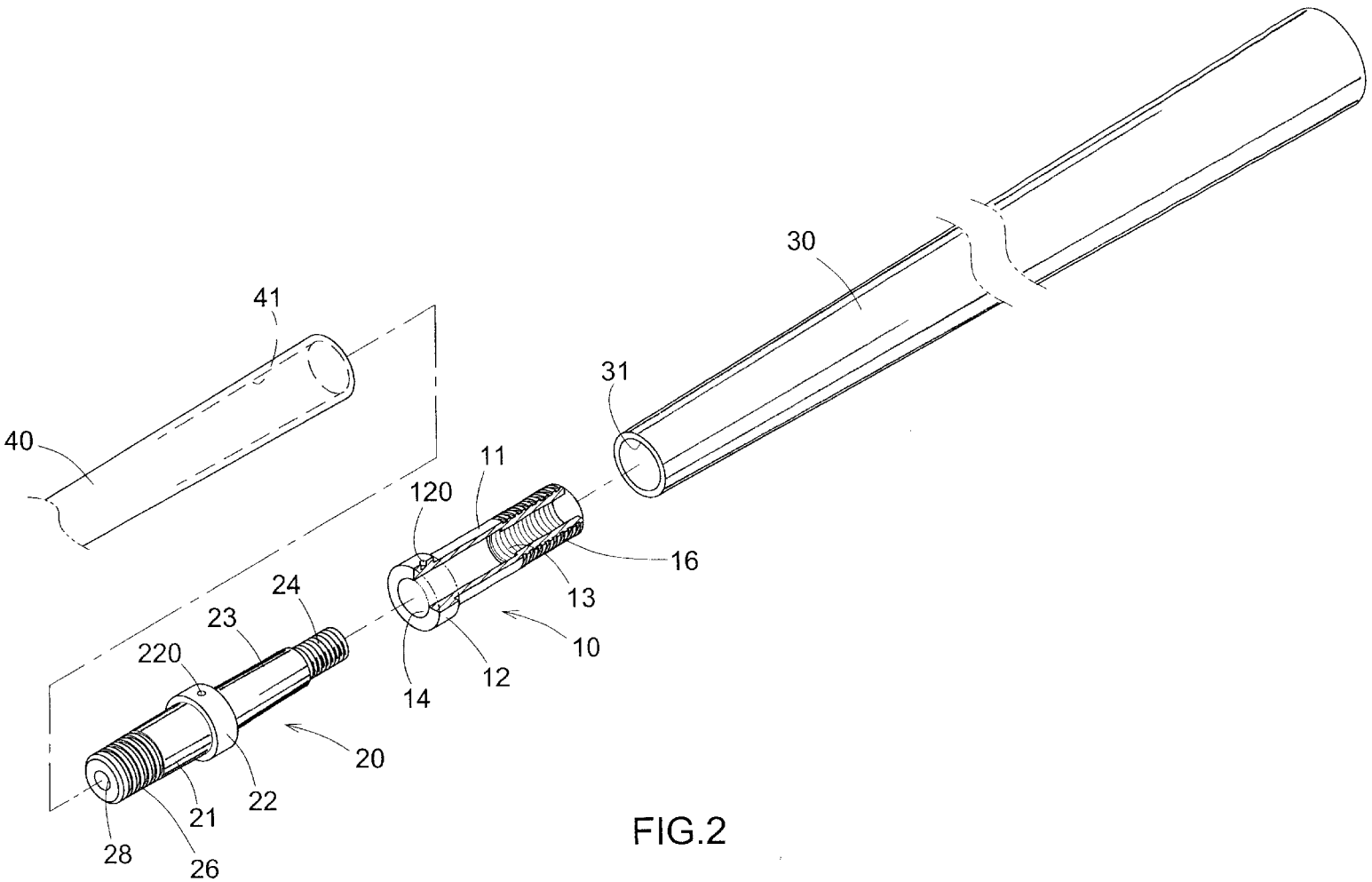
FIG. 2 is an exploded perspective assembly view of a replaceable golf club in accordance with a preferred embodiment of the present invention.

Referring to the drawings and initially to FIGS. 1–3 and 3A, a replaceable golf club in accordance with a preferred embodiment of the present invention comprises a primary rod 30, a secondary rod 40 combined with the primary rod 30, an upper insertion tube 10 inserted into a distal end of the primary rod 30, and a lower insertion tube 20 inserted into a distal end of the primary rod 40.

Both of the primary rod 30 and the secondary rod 40 are made of carbon fiber. In addition, the primary rod 30 is formed with an insertion hole 31, and the secondary rod 40 is formed with an insertion hole 41.

The upper insertion tube 10 made of metallic material is inserted into the insertion hole 31 of the primary rod 30. The upper insertion tube 10 is a hollow tube and includes an insertion portion 11 inserted into and secured in the insertion hole 31 of the primary rod 30 by adhesive glue.

Preferably, the insertion hole 31 of the primary rod 30 has a tapered shape, and the insertion portion 11 of the upper insertion tube 10 has a tapered shape to mate with that of the insertion hole 31 of the primary rod 30, so that the upper insertion tube 10 and the primary rod 30 are co-axial.

In addition, the insertion portion 11 of the upper insertion tube 10 has an outer wall formed with a helical groove 16. Thus, after the adhesive glue is attached on the insertion portion 11 of the upper insertion tube 10, the insertion portion 11 of the upper insertion tube 10 can be inserted into and secured in the insertion hole 31 of the primary rod 30 easily and conveniently by rotation of the helical groove 16.

The upper insertion tube 10 includes an upper shock absorbing portion 12 formed on one end of the insertion portion 11 and having an outer diameter greater than that of the insertion portion 11. The upper shock absorbing portion 12 is rested on and flush with a distal end of the primary rod 30. The upper insertion tube 10 has an inner wall having a first portion formed with a screw bore 13, and a second portion formed with a guide groove 14 having an inner diameter greater than that of the screw bore 13.

Figure 3:
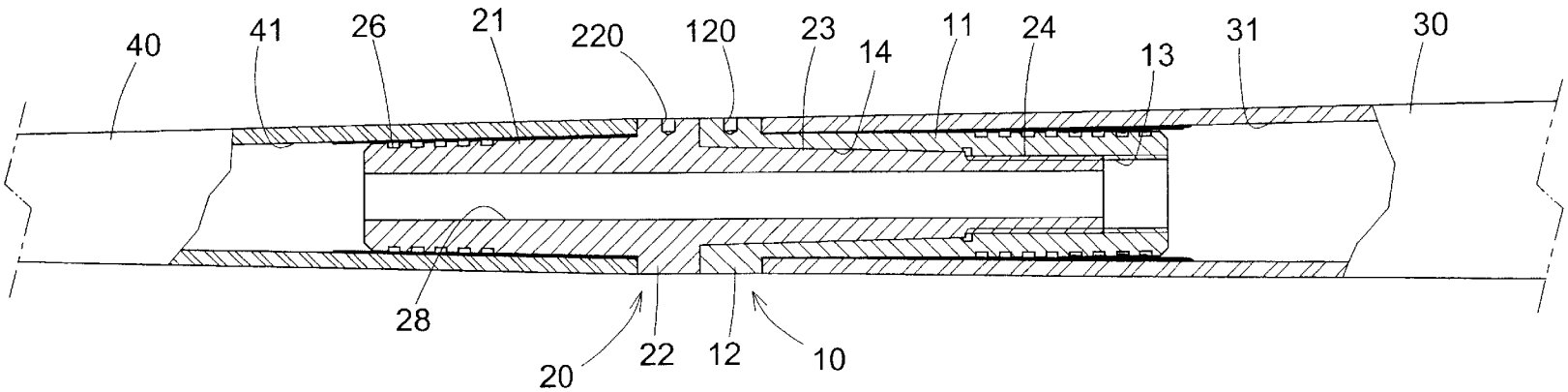
FIG. 3 is a plan cross-sectional assembly view of the replaceable golf club as shown in FIG. 2.
Figure 3A:
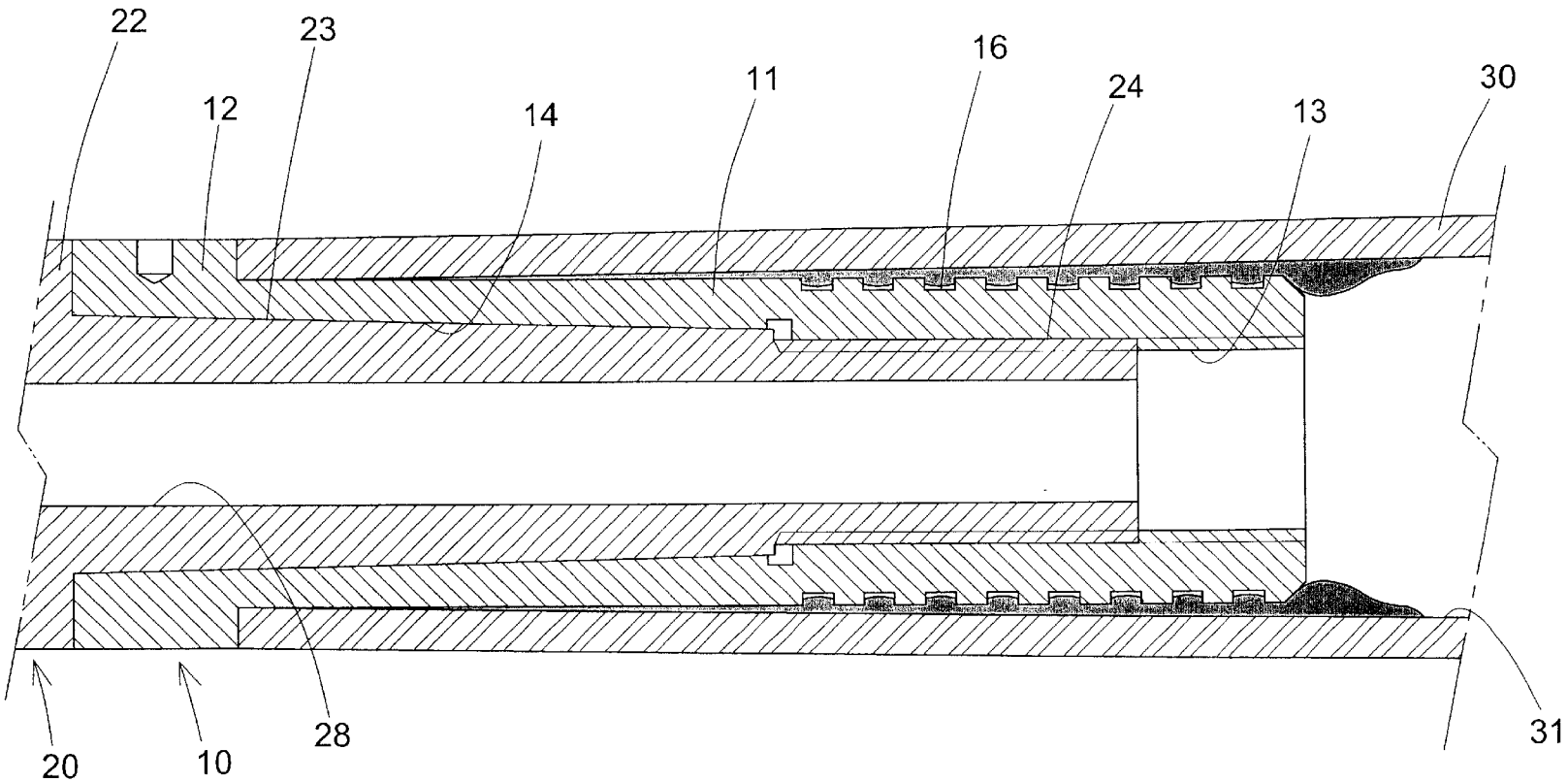
FIG. 3A is a partially cut-away enlarged view of the replaceable golf club as shown in FIG. 3.

The lower insertion tube 20 made of metallic material is inserted into the insertion hole 41 of the primary rod 40. The upper insertion tube 10 can be combined with the lower insertion tube 20, so that the primary rod 30 can be combined with the secondary rod 40 to form a golf club as shown in FIG. 3. The lower insertion tube 20 is also a hollow tube and includes an insertion portion 21 inserted into and secured in the insertion hole 41 of the secondary rod 40 by adhesive glue.

Preferably, the insertion hole 41 of the secondary rod 40 has a tapered shape, and the insertion portion 21 of the lower insertion tube 20 has a tapered shape to mate with that of the insertion hole 41 of the secondary rod 40, so that the lower insertion tube 20 and the secondary rod 40 are co-axial.

In addition, the insertion portion 21 of the lower insertion tube 20 has an outer wall formed with a helical groove 26. Thus, after the adhesive glue is attached on the insertion portion 21 of the lower insertion tube 20, the insertion portion 21 of the lower insertion tube 20 can be inserted into and secured in the insertion hole 41 of the secondary rod 40 easily and conveniently by rotation of the helical groove 26.

The lower insertion tube 20 includes a lower shock absorbing portion 22 formed on one end of the insertion portion 21 and having an outer diameter greater than that of the insertion portion 21. The lower shock absorbing portion 22 is rested on and flush with a distal end of the secondary rod 40. The lower insertion tube 20 includes a shaft portion 23 formed on and protruded from the lower shock absorbing portion 22. The shaft portion 23 of the lower insertion tube 20 can be inserted into the guide groove 14 of the upper insertion tube 10 and has a distal end formed with a screw portion 24 that can be screwed into the screw bore 13 of the upper insertion tube 10.

Preferably, the guide groove 14 of the upper insertion tube 10 has a tapered shape, and the shaft portion 23 of the lower insertion tube 20 has a tapered shape to mate with that of the guide groove 14 of the upper insertion tube 10, so that the upper insertion tube 10 and the lower insertion tube 20 are co-axial. Thus, the screw portion 24 of the lower insertion tube 20 can be screwed into the screw bore 13 of the upper insertion tube 10 easily and conveniently.

In such a manner, the upper insertion tube 10 is co-axial with the primary rod 30, the lower insertion tube 20 is co-axial with the secondary rod 40, and the upper insertion tube 10 is co-axial with the lower insertion tube 20, so that the primary rod 30 is co-axial with the secondary rod 40.

In addition, the lower insertion tube 20 has an inner wall formed with a through hole 28 extending through a whole length of the lower insertion tube 20 and communicating with the insertion hole 41 of the secondary rod 40 and the insertion hole 31 of the primary rod 30 to provide an air ventilating effect. In addition, the insertion portion 21 of the lower insertion tube 20 can be inserted into and secured in the insertion hole 41 of the secondary rod 40 easily and conveniently by the compressible effect of the through hole 28 of the lower insertion tube 20.

In assembly, the insertion portion 11 of the upper insertion tube 10 is initially inserted into and secured in the insertion hole 31 of the primary rod 30 with the upper shock absorbing portion 12 being rested on and flush with the distal end of the primary rod 30, and the insertion portion 21 of the lower insertion tube 20 is inserted into and secured in the insertion hole 41 of the secondary rod 40 with the lower shock absorbing portion 22 being rested on and flush with the distal end of the secondary rod 40 as shown in FIG. 1.

The shaft portion 23 of the lower insertion tube 20 is then inserted into the guide groove 14 of the upper insertion tube 10, and the screw portion 24 is then screwed into the screw bore 13 of the upper insertion tube 10, until the upper shock absorbing portion 12 is rested on the lower shock absorbing portion 22, so that the primary rod 30 may be combined with the secondary rod 40 to form a golf club as shown in FIG. 3.

Figure 4:
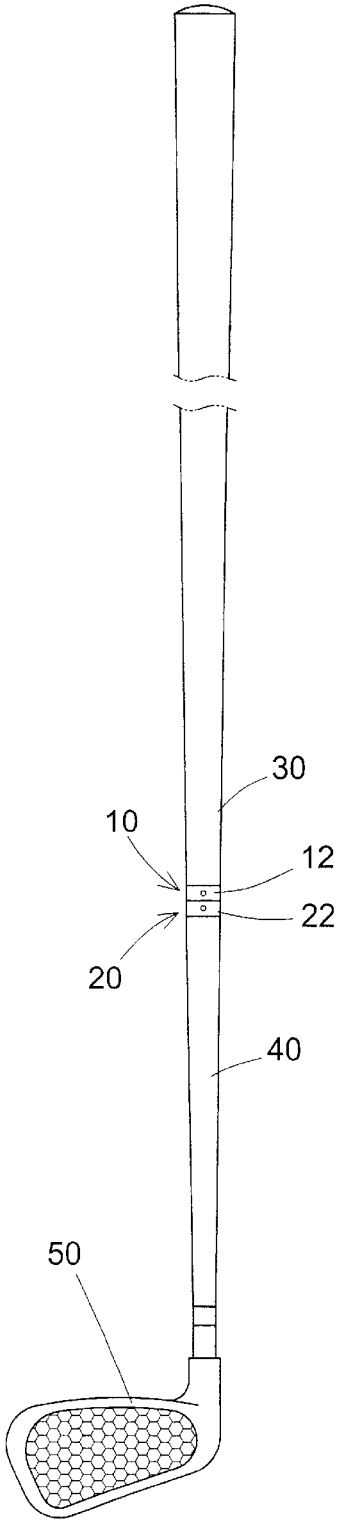
FIG. 4 is a schematic assembly view of the replaceable golf club as shown in FIG. 3 in use.
Figure 5:
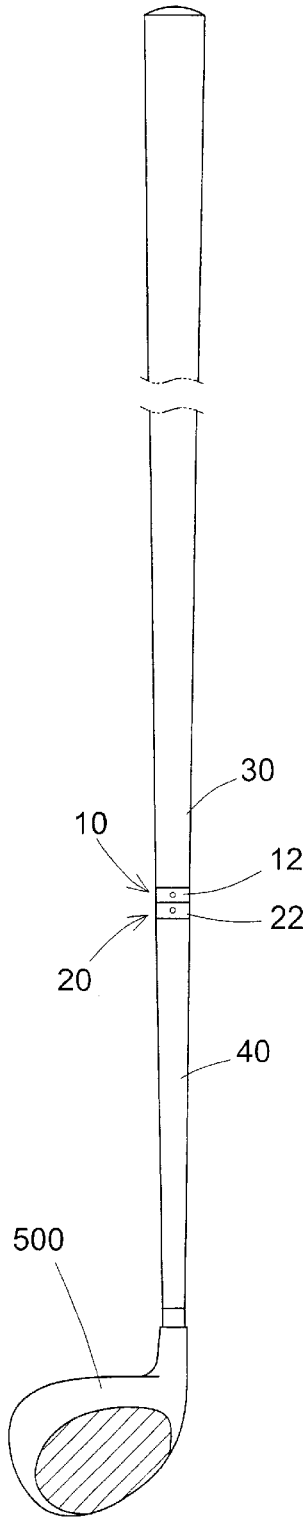
FIG. 5 is a schematic assembly view of the replaceable golf club as shown in FIG. 3 in use.

Referring to FIGS. 4 and 5, the primary rod 30 may be mated with a secondary rod 40 and a striking head 50 to form a golf club as shown in FIG. 4, and may be mated with a secondary rod 40 and a striking head 500 to form another golf club as shown in FIG. 5. Thus, the primary rod 30 may be mated with different kinds of secondary rods 40 (usually thirteen secondary rods 40), so that the user only needs to carry one primary rod and thirteen secondary rods without having to carry thirteen golf clubs, thereby facilitating the user carrying the golf club.

The upper shock absorbing portion 12 of the upper insertion tube 10 is formed with a detachment hole 120, and the lower shock absorbing portion 22 of the lower insertion tube 20 is formed with a detachment hole 220, so that the user may use two hook-shaped wrenches to lock the detachment hole 120 of the upper shock absorbing portion 12 and the detachment hole 220 of the lower shock absorbing portion 22, and to rotate the upper insertion tube 10 and the lower insertion tube 20 toward opposite directions, thereby detaching the primary rod 30 from the secondary rod 40.

In conclusion, the replaceable golf club in accordance with the present invention has the following advantages.

1. The upper shock absorbing portion 12 and the lower shock absorbing portion 22 are mounted between the upper insertion tube 10 and the lower insertion tube 20, thereby achieving a shock absorbing effect.

2. The user only needs to carry one primary rod and thirteen secondary rods without having to carry thirteen golf clubs, thereby facilitating the user carrying the golf club, and thereby reducing the weight of the golf club.

3. The screwing direction of the screw portion 24 of the lower insertion tube 20 and the screw bore 13 of the upper insertion tube 10 is different from the direction of the striking force of the golf club, so that the primary rod 30 may be combined with the secondary rod 40 stably and rigidly.

4. The upper shock absorbing portion 12 of the upper insertion tube 10 is formed with a detachment hole 120, and the lower shock absorbing portion 22 of the lower insertion tube 20 is formed with a detachment hole 220, thereby facilitating the user detaching the primary rod 30 from the secondary rod 40.

5. The screw portion 24 is located on the distal end the shaft portion 23 of the lower insertion tube 20, thereby preventing the lower insertion tube 20 from being broken due to a stress concentration effect.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A replaceable golf club, comprising:

a primary rod;

a secondary rod combined with the primary rod;

an upper insertion tube inserted into a distal end of the primary rod and including an upper shock absorbing portion rested on and flush with the distal end of the primary rod;

the upper insertion tube having an inner wall having a first portion formed with a screw bore and a second portion formed with a guide groove having an inner diameter greater than that of the screw bore;

the guide groove of the upper insertion tube having a tapered shape;

a lower insertion tube inserted into a distal end of the secondary rod and including a lower shock absorbing portion rested on and flush with the distal end of the secondary rod;

the lower insertion tube includes a shaft portion inserted into the guide groove of the upper insertion tube, the shaft portion having a distal end formed with a screw portion screwed into the screw bore of the upper insertion tube; and the shaft portion of the lower insertion tube having a tapered shape to mate with that of the guide groove of the upper insertion tube, so that the upper insertion tube and the lower insertion tube are co-axial.

2. The replaceable golf club in accordance with claim 1, wherein the primary rod is formed with an insertion hole, the upper insertion tube includes an insertion portion secured in the insertion hole of the primary rod, the secondary rod is formed with an insertion hole, and the lower insertion tube includes an insertion portion secured in the insertion hole of the secondary rod.

3. The replaceable golf club in accordance with claim 2, wherein the insertion hole of the primary rod has a tapered shape, and the insertion portion of the upper insertion tube has a tapered shape to mate with that of the insertion hole of the primary rod, so that the upper insertion tube and the primary rod are co-axial.

4. The replaceable golf club in accordance with claim 2, wherein the insertion hole of the secondary rod has a tapered shape, and the insertion portion of the lower insertion tube has a tapered shape to mate with that of the insertion hole of the secondary rod, so that the lower insertion tube and the secondary rod are co-axial.

5. The replaceable golf club in accordance with claim 2, wherein the insertion portion of the upper insertion tube has an outer wall formed with a helical groove, so that the insertion portion of the upper insertion tube can be inserted into and secured in the insertion hole of the primary rod easily and conveniently by rotation of the helical groove.

6. The replaceable golf club in accordance with claim 2, wherein the insertion portion of the lower insertion tube has an outer wall formed with a helical groove, so that the insertion portion of the lower insertion tube can be inserted into and secured in the insertion hole of the secondary rod easily and conveniently by rotation of the helical groove.

7. The replaceable golf club in accordance with claim 2, wherein the lower insertion tube has an inner wall formed with a through hole extending through a whole length of the lower insertion tube and communicating with the insertion hole of the secondary rod and the insertion hole of the primary rod to provide an air ventilating effect.

8. The replaceable golf club in accordance with claim 7, wherein the insertion portion of the lower insertion tube can be inserted into and secured in the insertion hole of the secondary rod easily and conveniently by a compressible effect of the through hole of the lower insertion tube.

9. The replaceable golf club in accordance with claim 2, wherein the insertion portion of the lower insertion tube has a shape mating with that of he insertion hole of the secondary rod.

10. The replaceable golf club in accordance with claim 1, wherein the lower shock absorbing portion being secured with the upper shock absorbing portion.

11. The replaceable golf club in accordance with claim 1, wherein the screwing direction of the screw portion of the lower insertion tube and the screw bore of the upper insertion tube is different from the direction of the striking force of the golf club, so that the primary rod is combined with the secondary rod stably and rigidly.

12. The replaceable golf club in accordance with claim 1, wherein the upper shock absorbing portion of the upper insertion tube is formed with a detachment hole, and the lower shock absorbing portion of the lower insertion tube is formed with a detachment hole.

13. The replaceable golf club in accordance with claim 1, wherein the upper insertion tube is co-axial with the primary rod, the lower insertion tube is co-axial with the secondary rod, and the upper insertion tube is co-axial with the lower insertion tube, so that the primary rod is co-axial with the secondary rod.

* * * * *